US012102189B2

(12) United States Patent
Iuchi et al.

(10) Patent No.: US 12,102,189 B2
(45) Date of Patent: Oct. 1, 2024

(54) UPPER FOR SHOE

(71) Applicant: Shimano Inc., Osaka (JP)

(72) Inventors: Kadunori Iuchi, Osaka (JP); Junichi Kikuta, Osaka (JP); Toshiaki Aoki, Osaka (JP)

(73) Assignee: Shimano Inc., Osaka (JP)

( * ) Notice: Subject to any disclaimer, the term of this patent is extended or adjusted under 35 U.S.C. 154(b) by 48 days.

(21) Appl. No.: 17/827,005

(22) Filed: May 27, 2022

(65) Prior Publication Data

US 2023/0404213 A1 Dec. 21, 2023

(51) Int. Cl.
*A43B 23/07* (2006.01)
*A43C 1/06* (2006.01)

(52) U.S. Cl.
CPC ..... *A43C 1/06* (2013.01); *A43B 23/07* (2013.01)

(58) Field of Classification Search
CPC ..... A43B 23/07; A43B 5/008; A43B 5/02; A43B 5/18; A43C 1/06; A43C 11/00; A43C 11/165; A43C 11/004; A43C 11/148
USPC ..... 36/50.1
See application file for complete search history.

(56) References Cited

U.S. PATENT DOCUMENTS 4,468,870 A * 9/1984 Sternberg ..... A43B 5/008 36/130
5,317,820 A * 6/1994 Bell ..... A43B 7/20 36/114
5,497,564 A * 3/1996 Allen ..... A43C 5/00 24/713.7
7,523,567 B1 * 4/2009 McClelland ..... A43B 5/1666 36/132
8,230,618 B2 * 7/2012 Bruce ..... A43C 5/00 36/114
11,412,808 B2 * 8/2022 Hancock ..... A43B 1/04
11,419,385 B2 * 8/2022 Hancock ..... D04B 21/06
2004/0255486 A1 * 12/2004 Pawlus ..... A43B 3/16 36/114
2005/0268497 A1 * 12/2005 Alfaro ..... A43B 23/0255 36/1
2011/0225845 A1 * 9/2011 Dean ..... B29D 35/146 36/47
2013/0318822 A1 * 12/2013 Wang ..... A43B 3/248 36/83

(Continued)

FOREIGN PATENT DOCUMENTS

AU 2013366366 B2 6/2014

*Primary Examiner* — Timothy K Trieu
(74) *Attorney, Agent, or Firm* — Global IP Counselors, LLP

(57) ABSTRACT

An upper is provided for a shoe. The upper is basically provided with a base layer, a first reinforcement layer and a second reinforcement layer. The base layer includes a toe portion and a heel portion. The base layer has a joint free three-dimensional shape at least partly defining an interior foot receiving space. The first reinforcement layer is disposed on an outer side of a centerline of a toe-heel direction of the upper. The first reinforcement layer overlies a first heel area of the heel portion. The second reinforcement layer is disposed on an inner side of the centerline. The second reinforcement layer overlies a second heel area of the heel portion. The first reinforcement layer and the second reinforcement layer are separated at the heel portion.

17 Claims, 13 Drawing Sheets

(56) References Cited

U.S. PATENT DOCUMENTS

| | | | | |
|---|---|---|---|---|
| 2015/0150335 | A1* | 6/2015 | Healy | A43B 7/12 36/8.1 |
| 2015/0257487 | A1* | 9/2015 | Ruiz | A43B 23/07 36/108 |
| 2017/0105489 | A1* | 4/2017 | Lovett | A43C 11/165 |
| 2018/0343974 | A1* | 12/2018 | Hancock | D04B 1/26 |
| 2019/0008234 | A1 | 1/2019 | Christensen et al. | |
| 2021/0259365 | A1* | 8/2021 | Maselino | A43C 11/008 |

* cited by examiner

UPPER FOR SHOE

BACKGROUND

Technical Field

This disclosure generally relates to an upper for a shoe.

Background Information

Generally, most shoes have an upper and a sole. The upper is stitched or adhesively bonded to the sole to form an interior foot receiving space for securely receiving a foot. The upper is typically formed from one or more flexible materials such as a textile fabric, a leather, and/or a synthetic leather that are stitched or adhesively bonded together. The upper can also include rigid reinforcements as needed and/or desired. The upper defines an ankle opening for inserting the wearer's foot into the interior foot receiving space and for removing wearer's foot from the interior foot receiving space. In addition, the upper can include a lace or other closure to more securely retain the shoe to the wearer's foot within the interior foot receiving space.

SUMMARY

Generally, the present disclosure is directed to various features of an upper for a shoe.

In view of the state of the known technology and in accordance with a first aspect of the present disclosure, an upper is provided that basically comprises a base layer, a first reinforcement layer and a second reinforcement layer. The base layer includes a toe portion and a heel portion. The base layer has a joint free three-dimensional shape at least partly defining an interior foot receiving space. The first reinforcement layer is disposed on an outer side of a centerline of a toe-heel direction of the upper. The first reinforcement layer overlies a first heel area of the heel portion. The second reinforcement layer is disposed on an inner side of the centerline. The second reinforcement layer overlies a second heel area of the heel portion. The first reinforcement layer and the second reinforcement layer are separated at the heel portion.

With the upper according to the first aspect, the holding of the wearer's foot can be improved while still following the foot movement of the wearer's foot.

In accordance with a second aspect of the present disclosure, the upper according to the first aspect is configured so that the first reinforcement layer overlies a first toe area of the toe portion. The second reinforcement layer overlies a second toe area of the toe portion. The first reinforcement layer and the second reinforcement layer are separated at the toe portion.

With the upper according to the second aspect, it is possible to improve the following the foot movement of the wearer's foot.

In accordance with a third aspect of the present disclosure, the upper according to the first aspect or the second aspect is configured so that the first reinforcement layer extends continuously from the heel portion to the toe portion as a single strip.

With the upper according to the third aspect, the upper can firmly hold a first lateral side of the wearer's foot.

In accordance with a fourth aspect of the present disclosure, the upper according to any one of the first aspect to the third aspect is configured so that the second reinforcement layer extends continuously from the heel portion to the toe portion as a single strip.

With the upper according to the fourth aspect, the upper can firmly hold a second lateral side of the wearer's foot.

In accordance with a fifth aspect of the present disclosure, the upper according to any one of the first aspect to the fourth aspect further comprises an instep portion integrated with the base layer. The first reinforcement layer and the second reinforcement layer are separated at the instep portion.

With the upper according to the fifth aspect, the upper allows the wearer's foot to easily enter the upper and easy removal of the upper from the wearer's foot.

In accordance with a sixth aspect of the present disclosure, the upper according to any one of the first aspect to the fifth aspect further comprises a third reinforcement layer overlying the base layer and at least one of the first reinforcement layer and the second reinforcement layer.

With the upper according to the sixth aspect, it is possible to further improve the holding the wearer's foot.

In accordance with a seventh aspect of the present disclosure, the upper according to any one of the first aspect to the sixth aspect is configured so that the first reinforcement layer includes at least one of a rubber material, a resin material and a leather material, and the second reinforcement layer includes at least one of a rubber material, a resin material and a leather material.

With the upper according to the seventh aspect, the upper can remain sufficiently flexible to follow the movement of the wearer's foot.

In accordance with an eighth aspect of the present disclosure, the upper according to any one of the first aspect to the seventh aspect is configured so that the base layer is a fabric material.

With the upper according to the eighth aspect, the upper can easily follow the movement of the wearer's foot.

In accordance with a ninth aspect of the present disclosure, the upper according to the first aspect further comprises a closing arrangement provided to the base layer.

With the upper according to the ninth aspect, the upper can be tightened onto the wearer's foot.

In accordance with a tenth aspect of the present disclosure, the upper according to the ninth aspect is configured so that the closing arrangement includes a shoelace.

With the upper according to the tenth aspect, the upper can be easily tightened onto the wearer's foot.

In accordance with an eleventh aspect of the present disclosure, the upper according to the tenth aspect is configured so that the closing arrangement includes a tightener coupled to the shoelace.

With the upper according to the eleventh aspect, the upper can be easily tightened onto the wearer's foot.

In accordance with a twelfth aspect of the present disclosure, the upper according to the eleventh aspect is configured so that the closing arrangement includes a first strap provided to the outer side of the centerline, and a second strap provided to the inner side of the centerline, and the tightener is provided to one of the first strap and the second strap.

With the upper according to the twelfth aspect, the upper can be tightened onto the wearer's foot and reinforce the instep portion.

In accordance with a thirteenth aspect of the present disclosure, the upper according to the eleventh aspect is configured so that the tightener includes a reel based tightener.

With the upper according to the thirteenth aspect, the shoelace can be easily tightened and loosened.

In accordance with a fourteenth aspect of the present disclosure, the upper according to the tenth aspect is configured so that the closing arrangement includes a lace guide provided to the base layer, and the shoelace is laced through the lace guide.

With the upper according to the fourteenth aspect, the upper can be tightened in a relatively inexpensive manner.

In accordance with a fifteenth aspect of the present disclosure, the upper according to any one of the first aspect to the fourteenth aspect is configured so that the base layer further includes a middle portion, and the toe portion, the heel portion and the middle portion define a sock shape.

With the upper according to the fifteenth aspect, the upper can be reliably manufactured.

In accordance with a sixteenth aspect of the present disclosure, the upper according to any one of the first aspect to the fifteenth aspect is configured so that a top edge of the first reinforcement layer is disposed above a most outwardly protruding point of the heel portion in a width direction perpendicular to the toe-heel direction and extending between the outer side and the inner side.

With the upper according to the sixteenth aspect, the heel of the wearer's foot can be reliably held in the upper.

In accordance with a seventeenth aspect of the present disclosure, the upper according to any one of the first aspect to the sixteenth aspect is configured so that a top edge of the second reinforcement layer is disposed above a most outwardly protruding point of the heel portion in a width direction perpendicular to the toe-heel direction and extending between the outer side and the inner side.

With the upper according to the seventeenth aspect, the heel of the wearer's foot can be further reliably held in the upper.

In accordance with an eighteenth aspect of the present disclosure, a shoe comprises the upper according to according to any one of the first aspect to the seventeenth aspect, and further comprises a sole attached to the upper.

With the shoe according to the eighteenth aspect, it is possible to provide a shoe that can improve holding of the wearer's foot while still following the foot movement of the wearer's foot.

Also, other objects, features, aspects and advantages of the disclosed upper will become apparent to those skilled in the art from the following detailed description, which, taken in conjunction with the annexed drawings, discloses preferred embodiments of the upper.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the shoe field from this disclosure that the following descriptions of the embodiments are provided for illustration only and not for the purpose of limiting the invention as defined by the appended claims and their equivalents.

Figure 1:
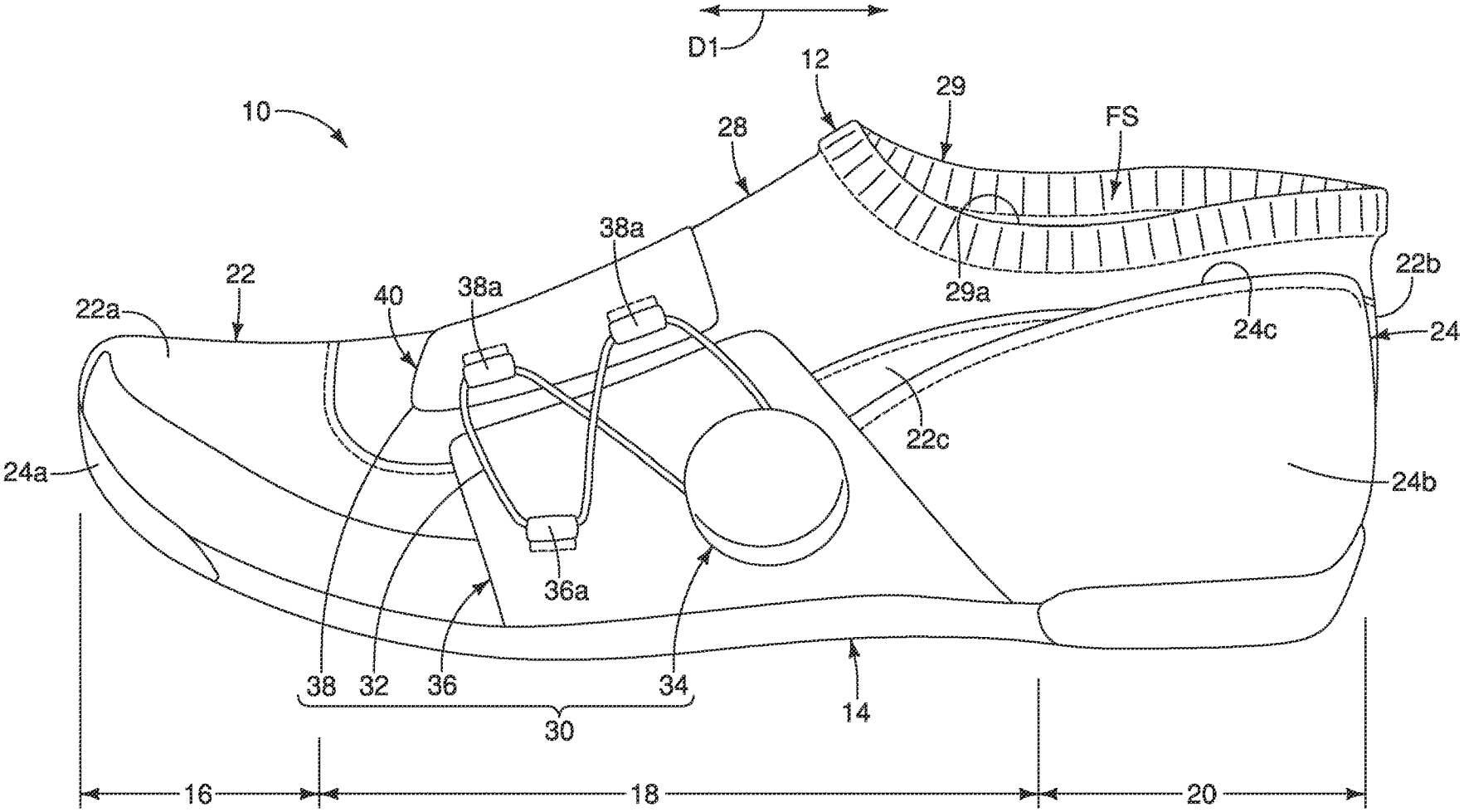
FIG. 1 is an outer side elevational view of a shoe having an upper in accordance with a first embodiment.
Figure 2:
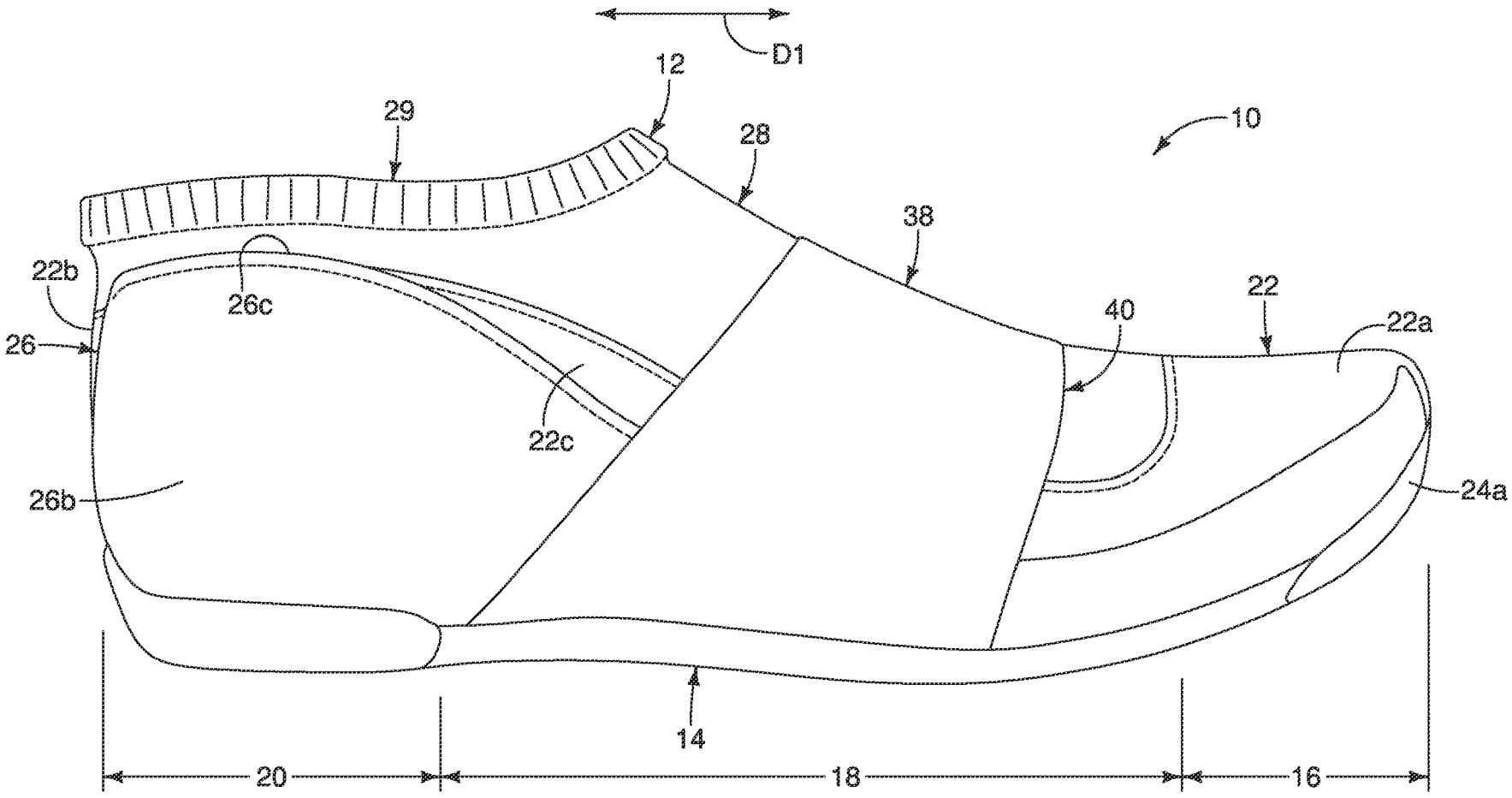
FIG. 2 is an inner side elevational view of the shoe illustrated in FIG. 1.
Figure 3:
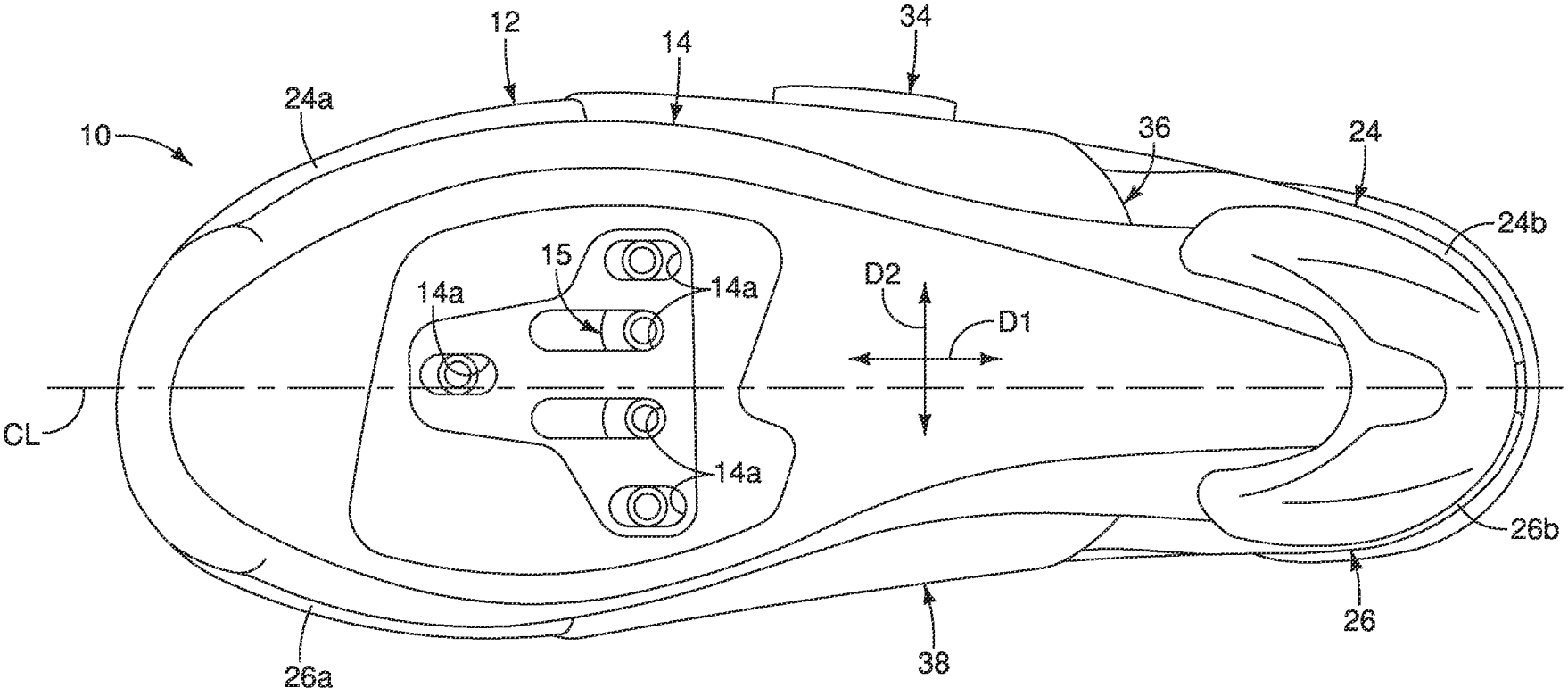
FIG. 3 is a bottom plan view of the shoe illustrated in FIGS. 1 and 2.
Figure 5:
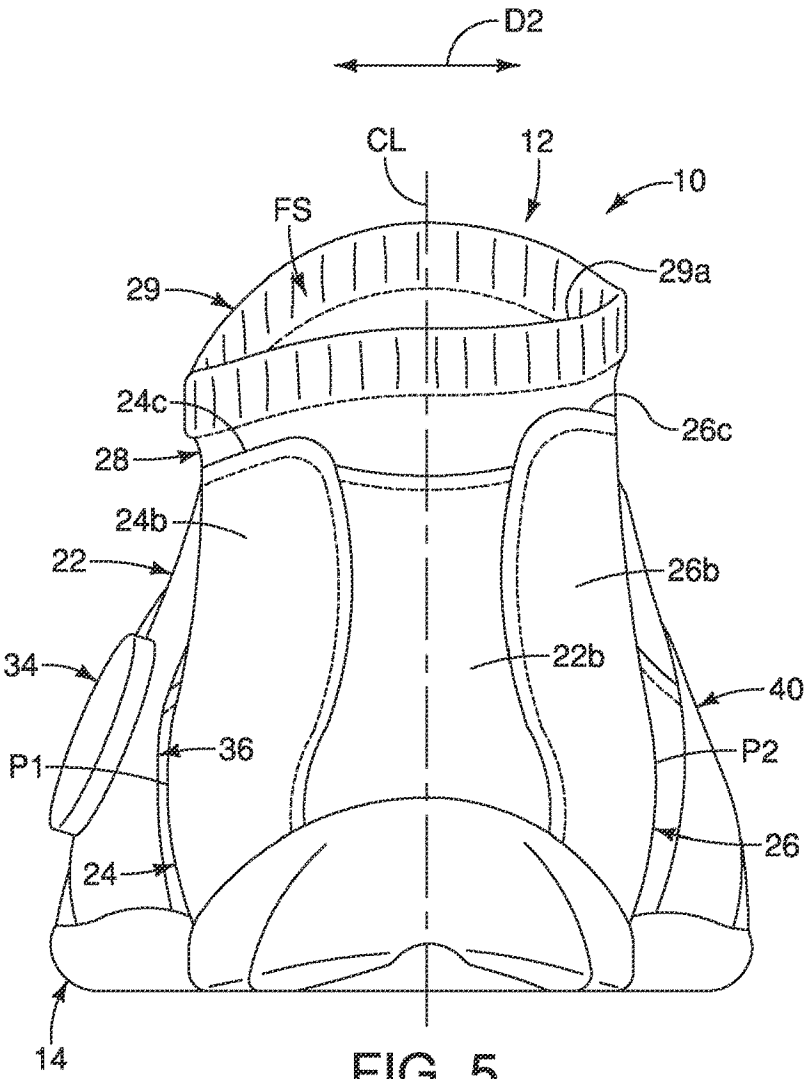
FIG. 5 is a rear end oblique view of the shoe illustrated in FIGS. 1 to 4.
Figure 4:
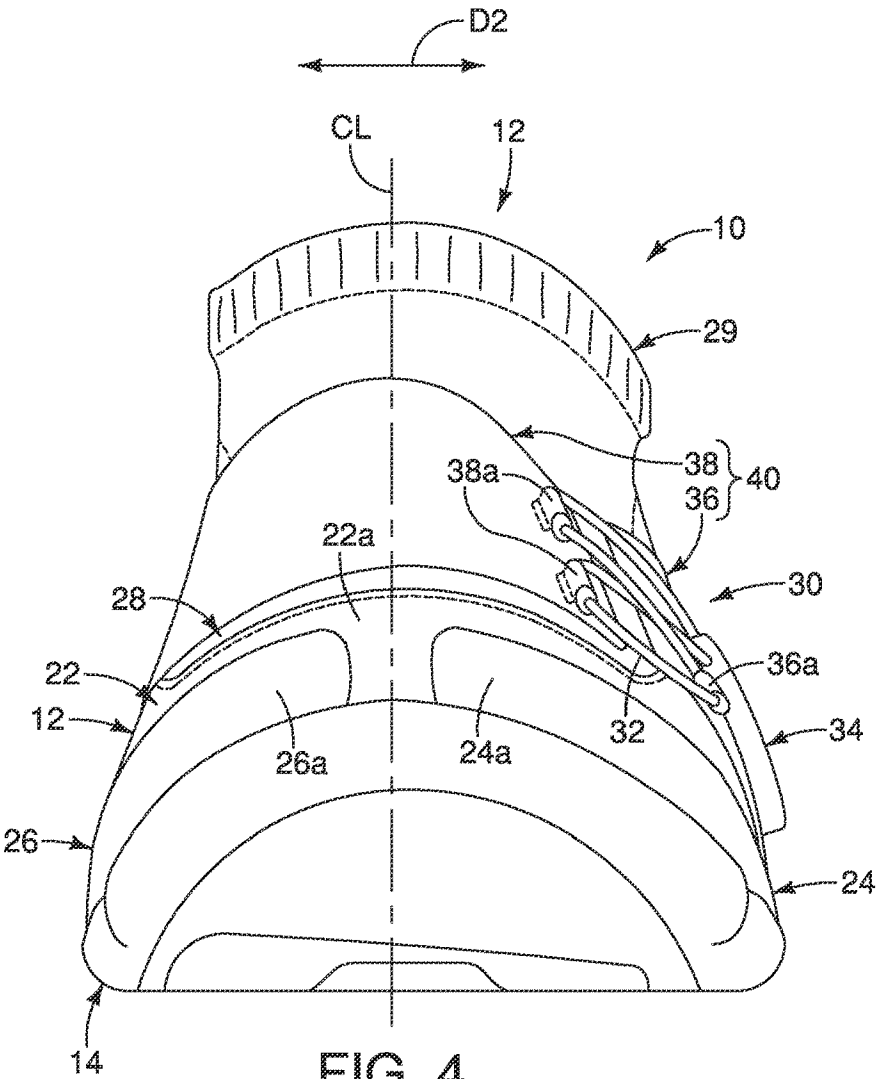
FIG. 4 is a front end oblique view of the shoe illustrated in FIGS. 1 to 3.

Referring initially to FIGS. 1 to 3, a shoe 10 is illustrated in accordance with a first embodiment of the present disclosure. The shoe 10 is a left shoe of a pair of left-right symmetric ones, in which the right shoe is omitted. The right shoe is identical to the shoe 10 (the left shoe), except that the right shoe is a mirror image of the shoe 10 (the left shoe). Accordingly, description of the shoe 10 applies equally to the right shoe. Therefore, a description will be provided for only one of the shoes (the left shoe 10). The shoe 10 is especially suitable for cycling. However, the shoe 10 can be used for other actives other than cycling as explained below.

It should be understood from the drawings and the description herein that the terms "inner side" and "inboard side" refer to the right side of a shoe for the left foot, and the left side of a shoe for the right foot. In other words, the inner side or the inboard side is the side of the shoe facing the shoe on the other foot of the wearer. Similarly, the terms "outer side" and "outboard side" refer to the left side of the shoe for the left foot and the right side of the shoe for the right foot. The outer side or the outboard side is the side of the shoe facing away from the shoe on the other foot. As well, the terms "inner side" and "inboard side" are used interchangeably with respect to the present disclosure. Similarly, the terms "outer side" and "outboard side" are also used interchangeably with respect to the description of the present disclosure. Also, the term "outer instep side" refer to the left side of the shoe in the instep area for the left foot and the right side of the shoe in the instep area for the right foot. Similarly, the term "inner instep side" refer to the right side of the shoe in the instep area for the left foot and the left side of the shoe in the instep area for the right foot.

Basically, the shoe 10 comprises an upper 12 and a sole 14. In other words, the shoe 10 comprises the upper 12, and further comprises the sole 14 which is attached to the upper 12. The upper 12 for the shoe 10 is not limited to the illustrated sole 14. As shown in FIGS. 1 to 3, the shoe 10 includes a forefoot portion 16, a midfoot portion 18 and a rear portion 20. The forefoot portion 16 is located on a front end in a toe-heel direction D1 of the upper 12. The toe-heel direction D1 is parallel to a longitudinal direction of the shoe 10. The midfoot portion 18 located rearward of the forefoot portion 16 and forward of the rear portion 20. The rear portion 20 is located on a rear end side in the toe-heel direction D1. The forefoot portion 16 forms the front end side of the sole 14. The rear portion 20 forms the rear end side of the sole 14. The forefoot portion 16 is a region on which the toe of the wearer is placed. The rear portion 20 is a region on which the heel of the wearer is placed. The midfoot portion 18 is a region on which the central portion of the foot of the wearer (i.e., the central portion in the toe-heel direction D1) is placed.

The sole 14 supports the upper 12. Specifically, the sole 14 is attached to the upper 12 in a conventional manner, such as with stitching, adhesives, and/or molding onto of the upper 12. Thus, the upper 12 and the sole 14 are integrated together. The material of the sole 14 and the tread of the sole 14 will depend on the particular use of the shoe 10. Here, for example, the sole 14 includes an elastic polymer material such as synthetic rubber or polyurethane (e.g., a thermoplastic polyurethane). The sole 14 can be formed by injection molding and adhesively attached to the upper 12. While the sole 14 is illustrated as a single layer, the sole 14 is not limited to being a single layer. Rather, the sole 14 can have multiple layers of different materials as needed and/or or desired. Here, the sole 14 includes a plurality of cleat attachment openings 14*a* for attaching a bicycle shoe cleat. In the illustrated embodiment, the sole 14 is configured so that the shoe 10 can be used with either an off-road (MTB) cleat or a road cleat. The cleat attachment openings 14*a* can be omitted if not needed.

As seen in FIGS. 6 to 10, the upper 12 is illustrated without the sole 14. Here, the upper 12 is a low-cut style of upper. However, the upper 12 is not limited to the low-cut style, but may be of any style. The upper 12 basically comprises a base layer 22, a first reinforcement layer 24 and a second reinforcement layer 26. As explained below, the first reinforcement layer 24 is attached to a first lateral side of the upper 12, and the second reinforcement layer 26 is attached to a second lateral side of the upper 12. The second lateral side is the opposite side from the first lateral side.

The base layer 22 includes a toe portion 22*a* and a heel portion 22*b*. The base layer 22 further includes a middle portion 22*c*. The middle portion 22*a* is disposed between the toe portion 22*a* and the heel portion 22*b*. The toe portion 22*a*, the heel portion 22*b* and the middle portion 22*c* define a sock shape. Preferably, the base layer 22 has a joint free three-dimensional shape at least partly defining an interior foot receiving space FS.

Figure 6:
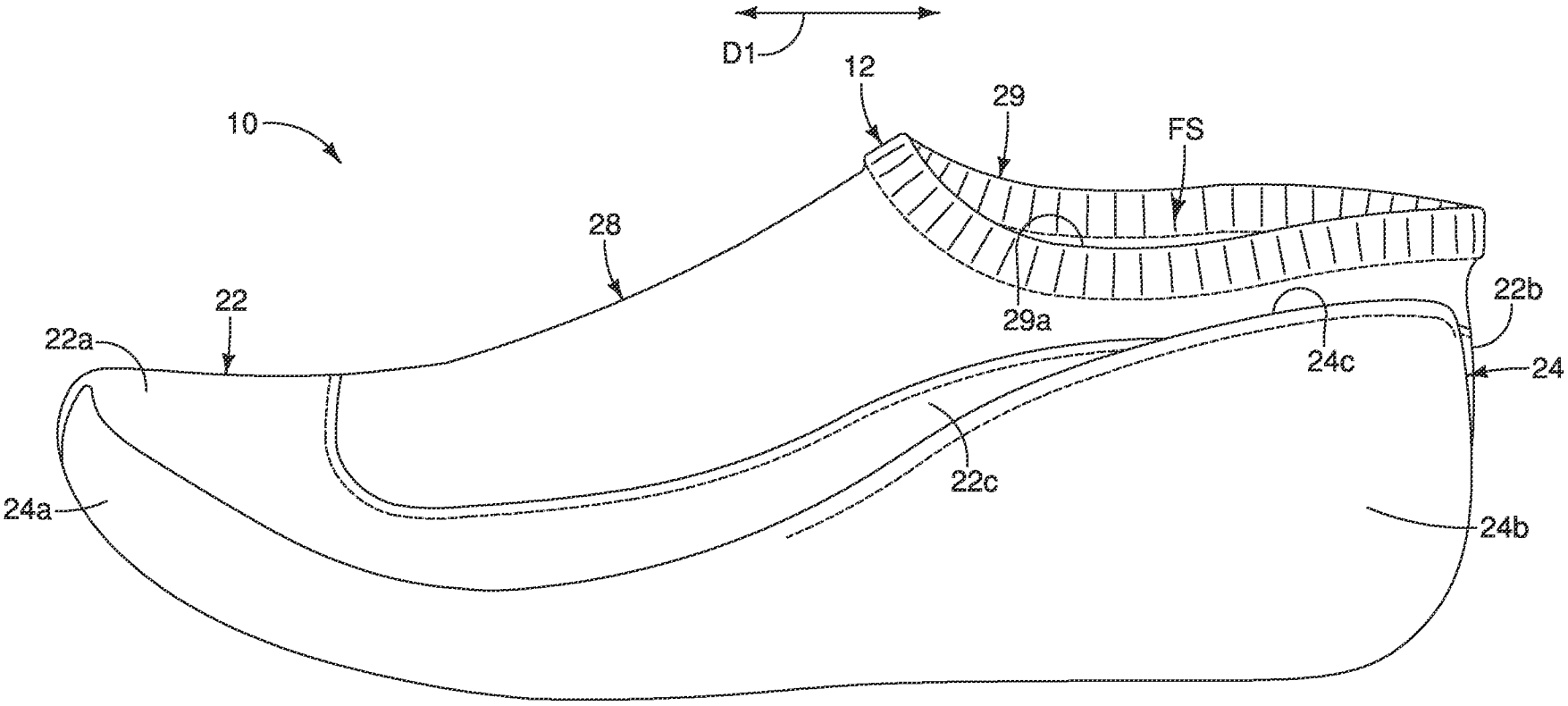
FIG. 6 is an outer side elevational view of the upper of the shoe illustrated in FIGS. 1 to 5.

As seen in FIG. 6, the first reinforcement layer 24 is disposed on an outer side of a centerline CL of the toe-heel direction D1 of the upper 12. Here, the first reinforcement layer 24 overlies a first toe area of the toe portion 22*a*. Also, here, the first reinforcement layer 24 overlies a first heel area of the heel portion 22*b*. Preferably, the first reinforcement layer 24 extends continuously from the heel portion 22*b* to the toe portion 22*a* as a single strip.

Figure 7:
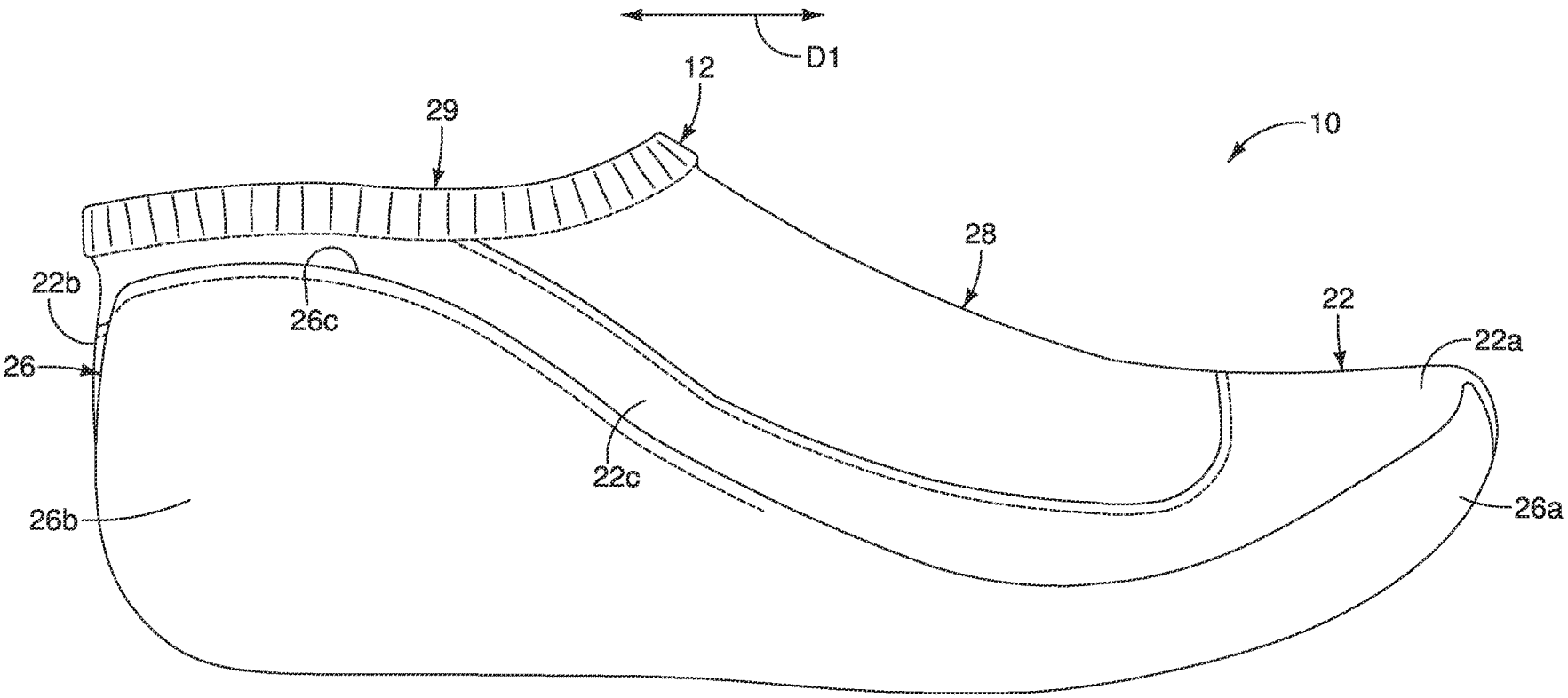
FIG. 7 is an inner side elevational view of the upper illustrated in FIG. 6.

Similarly, as seen in FIG. 7, the second reinforcement layer 26 is disposed on an inner side of the centerline CL. Here, the second reinforcement layer 26 overlies a second toe area of the toe portion 22*a*. Also, here, the second reinforcement layer 26 overlies a second heel area of the heel portion 22*b*. Preferably, the second reinforcement layer 26 extends continuously from the heel portion 22*b* to the toe portion 22*a* as a single strip.

Figure 8:
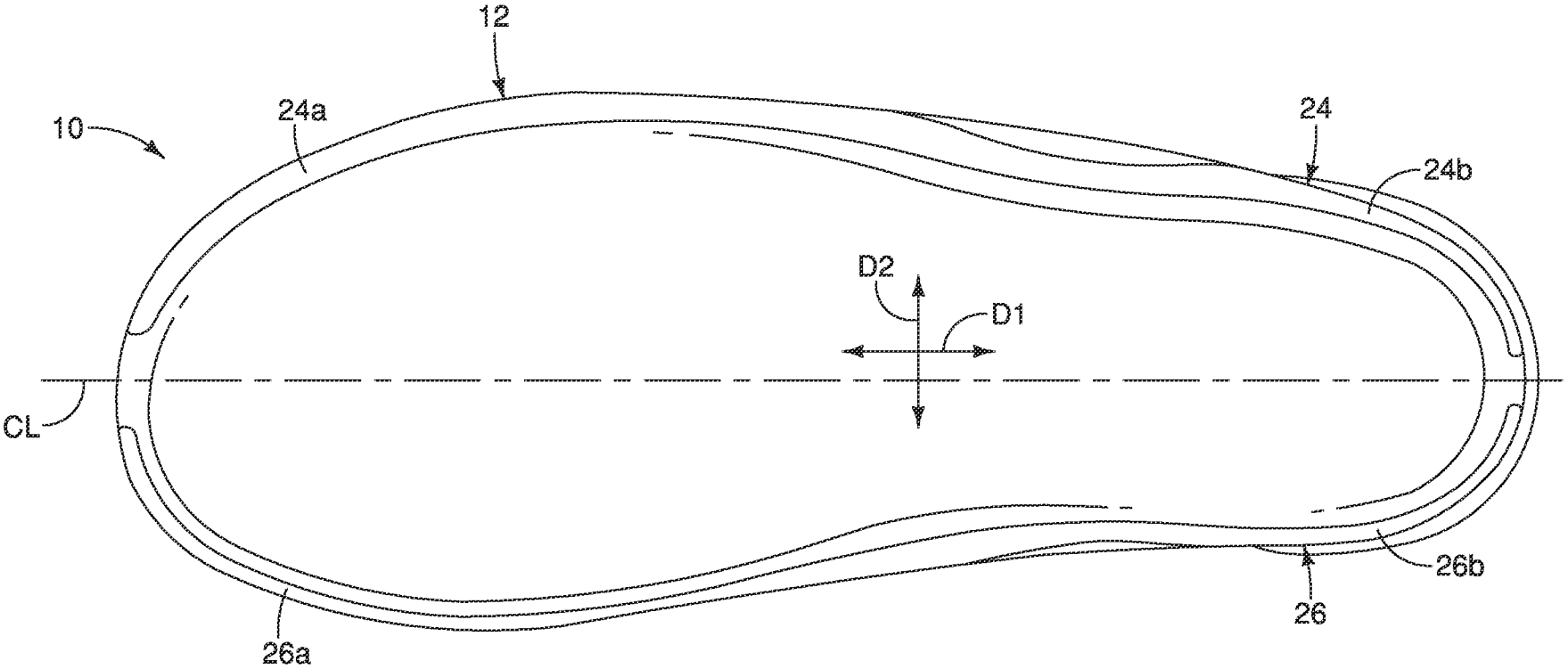
FIG. 8 is a bottom plan view of the upper illustrated in FIGS. 6 and 7.
Figure 10:
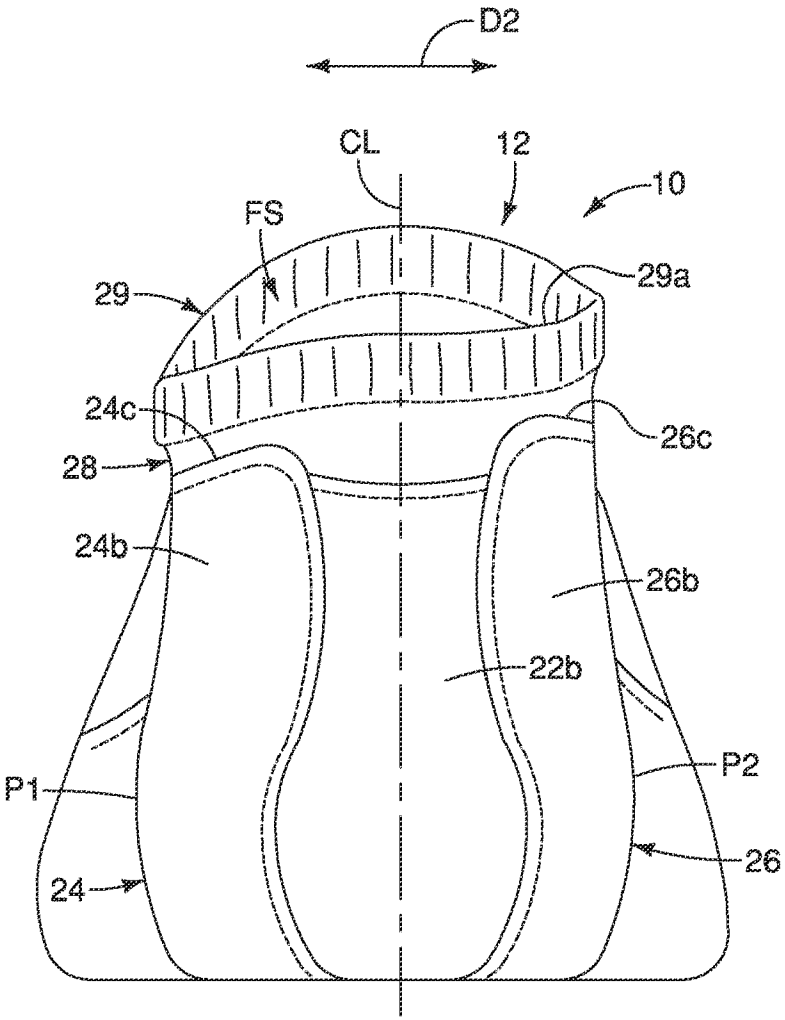
FIG. 10 is a rear end oblique view of the upper illustrated in FIGS. 6 to 9.
Figure 9:
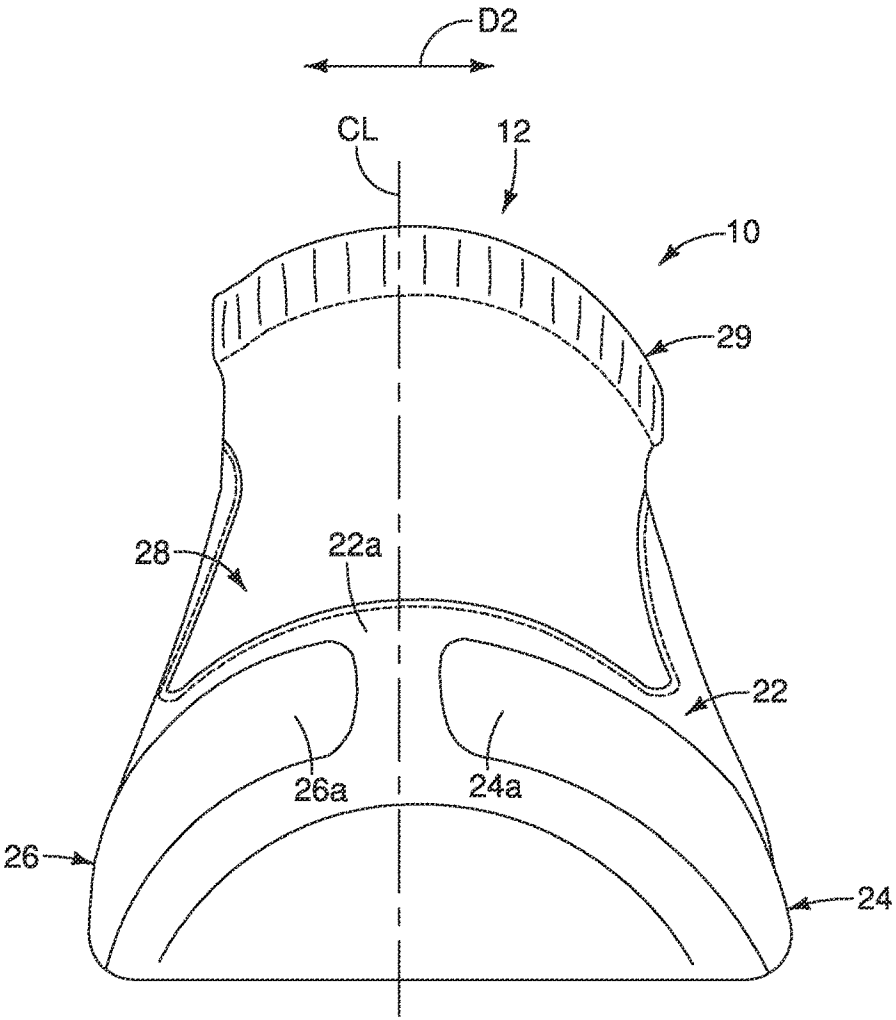
FIG. 9 is a front end oblique view of the upper illustrated in FIGS. 6 to 8.
Figure 11:
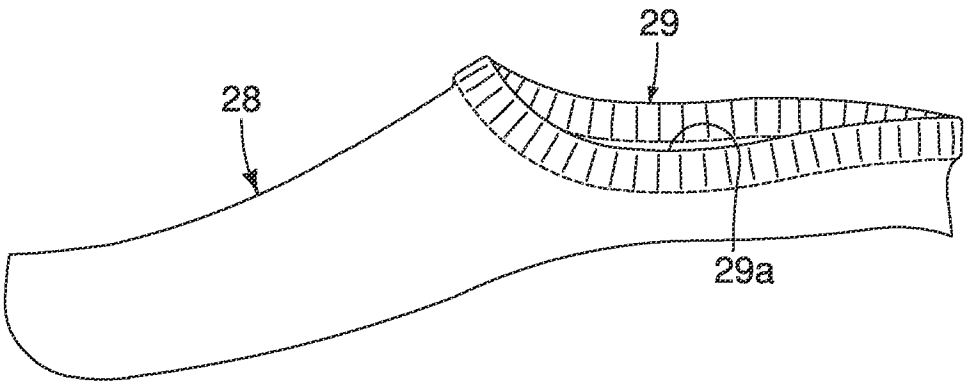
FIG. 11 is a side elevational view of an instep portion for the upper illustrated in FIGS. 6 to 9.
Figure 12:
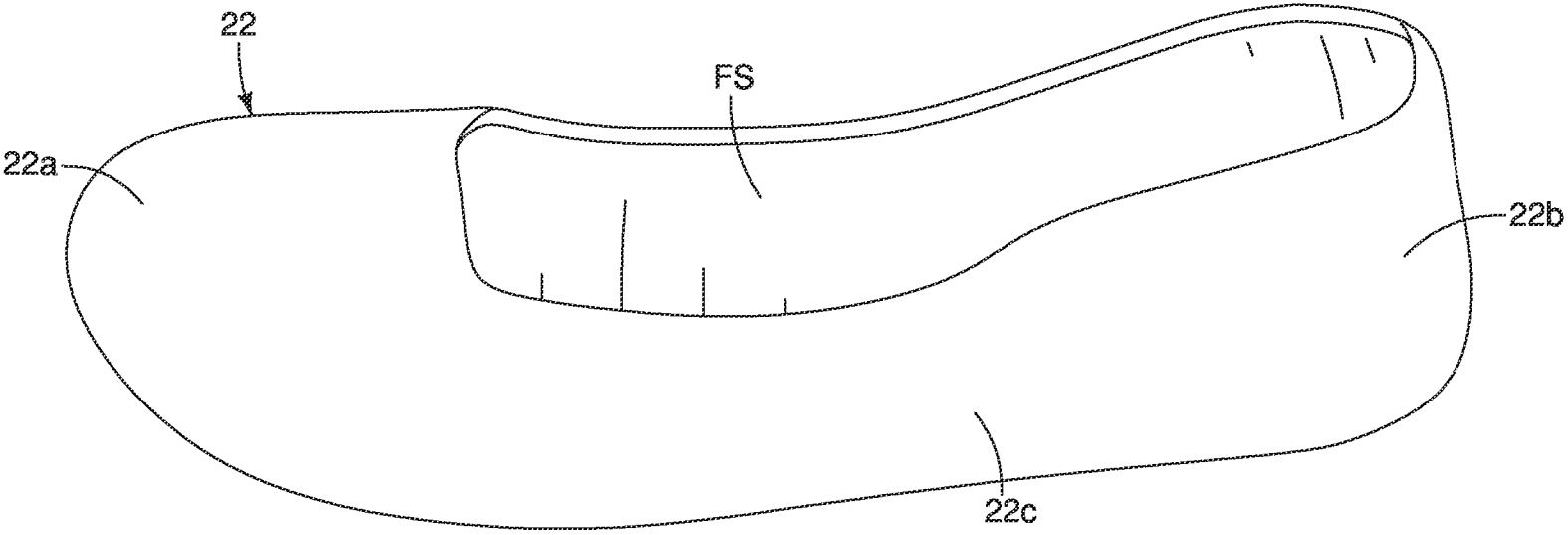
FIG. 12 is a side elevational view of a base layer for the upper illustrated in FIGS. 6 to 9.
Figure 13:
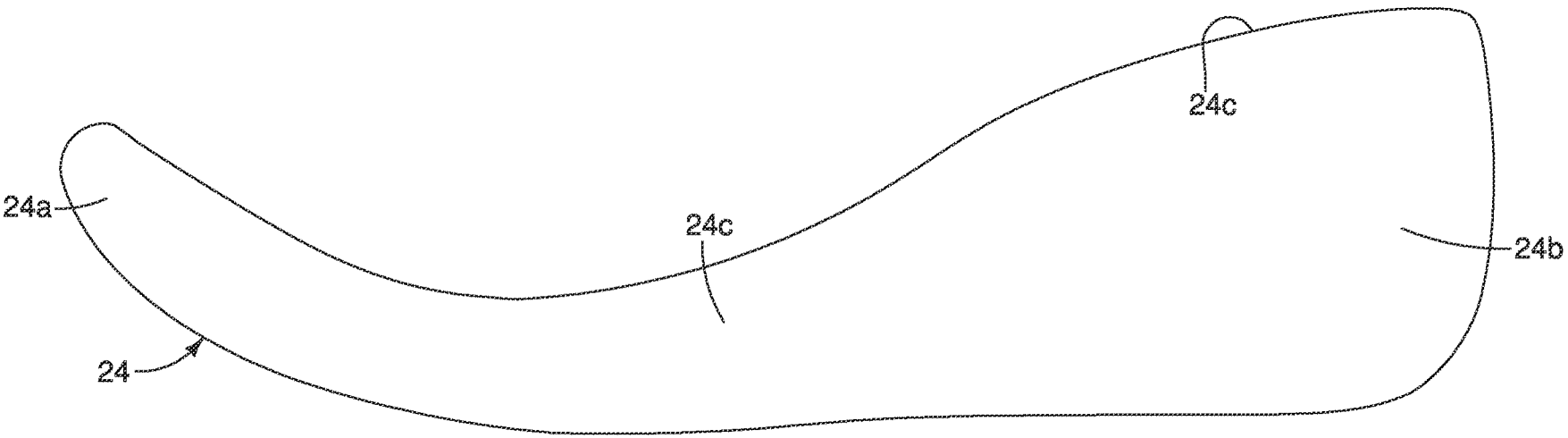
FIG. 13 is a side elevational view of a first reinforcement layer for the upper illustrated in FIGS. 6 to 9.
Figure 14:
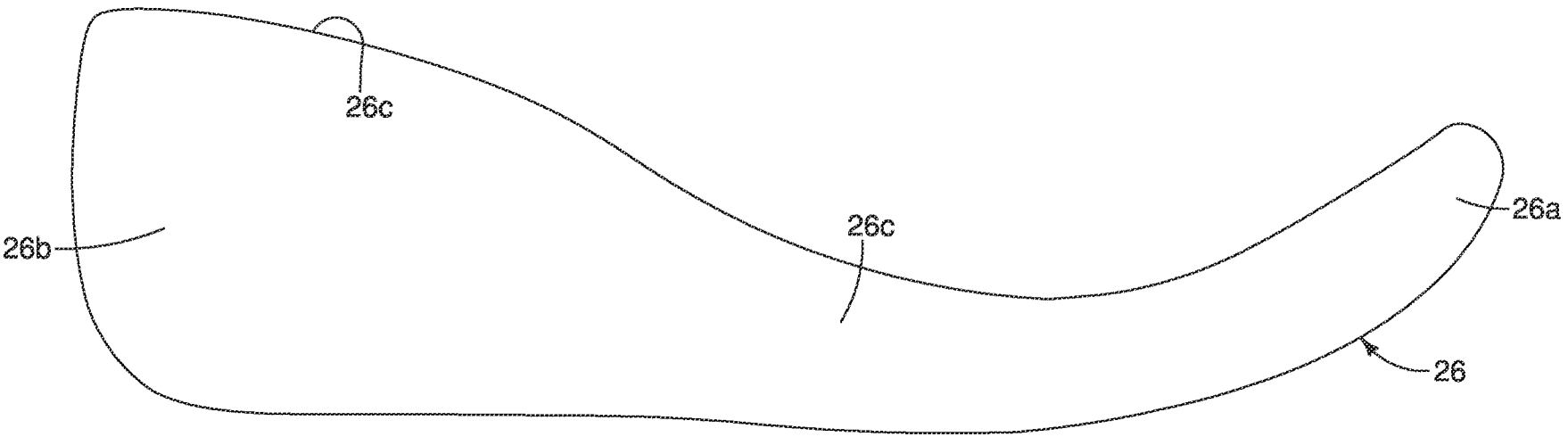
FIG. 14 is a side elevational view of a second reinforcement layer for the upper illustrated in FIGS. 6 to 9.
Figure 15:
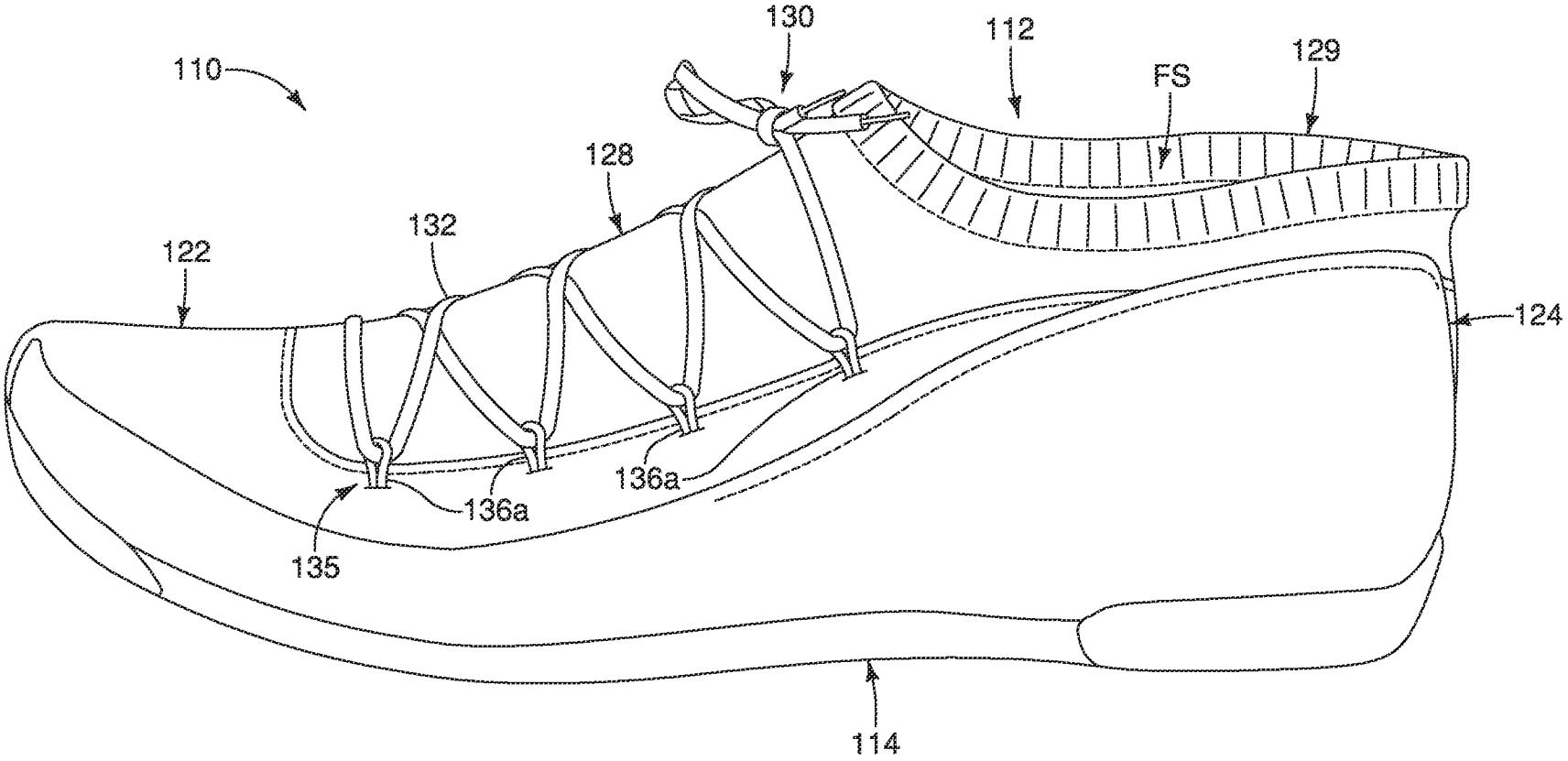
FIG. 15 is an outer side elevational view of a shoe having an upper in accordance with a second embodiment.
Figure 16:
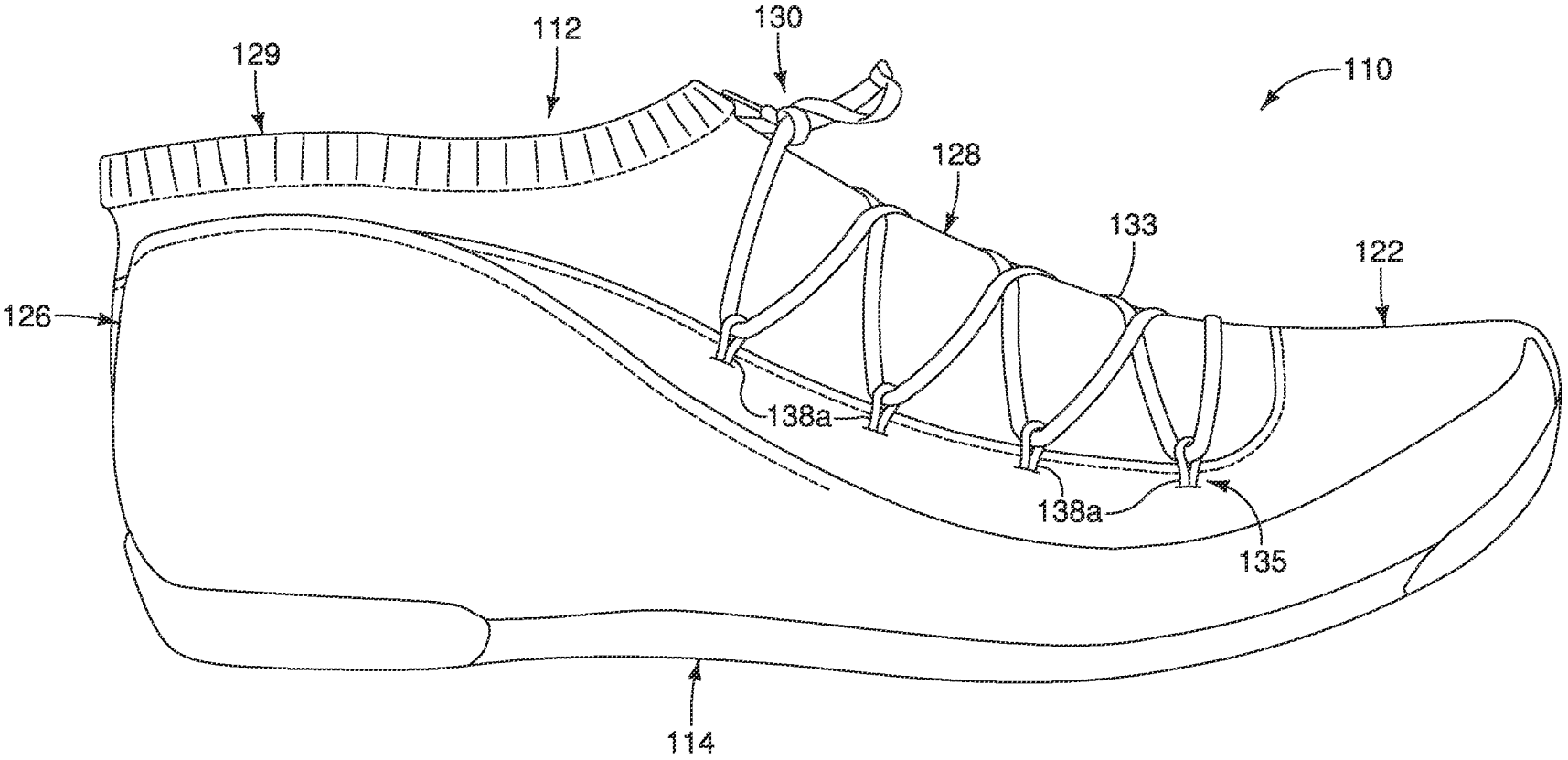
FIG. 16 is an inner side elevational view of the shoe illustrated in FIG. 15.
Figure 18:
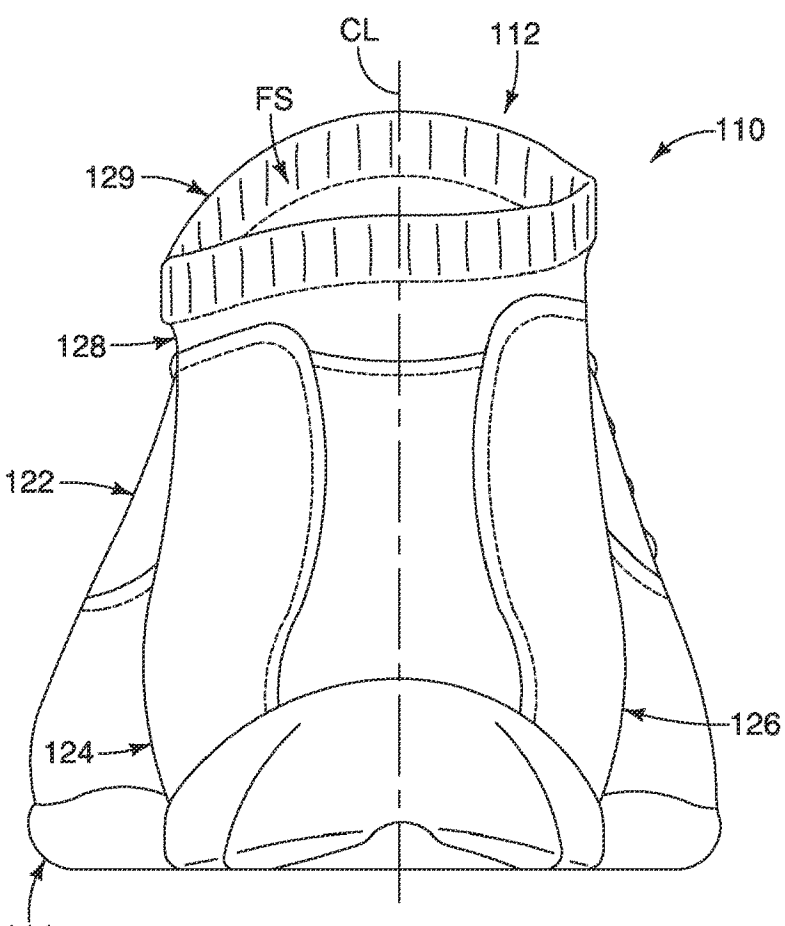
FIG. 18 is a rear end oblique view of the shoe illustrated in FIGS. 15 to 17.
Figure 17:
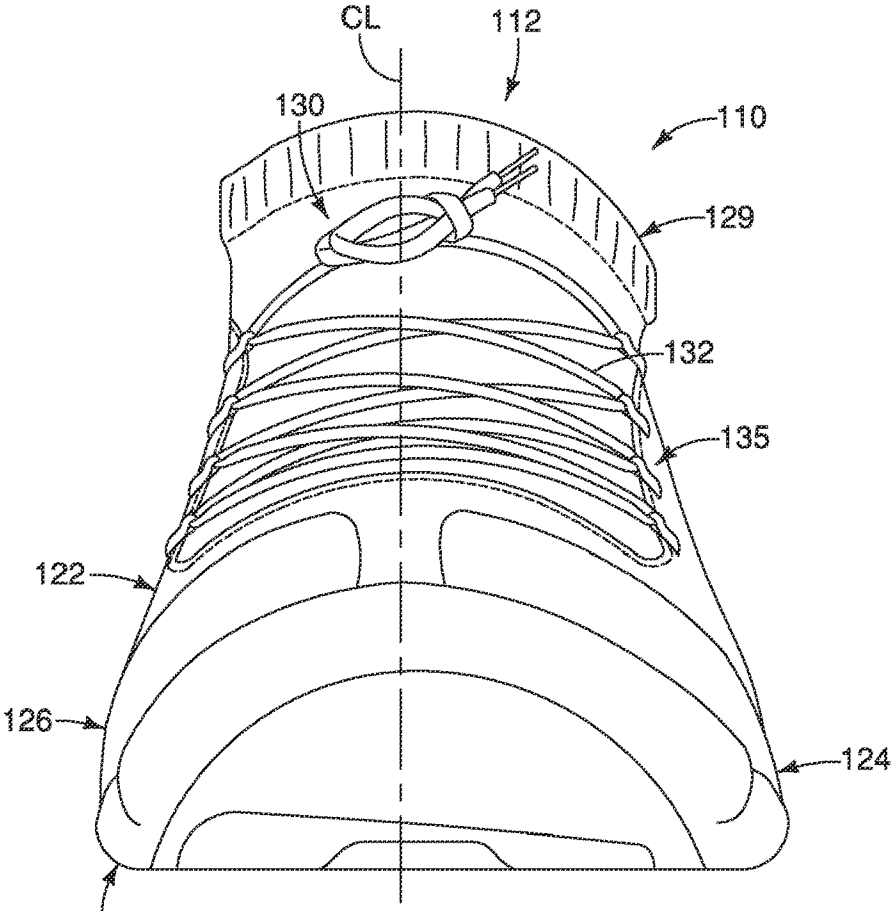
FIG. 17 is a front end oblique view of the shoe illustrated in FIGS. 15 and 16.

Referring now to FIGS. 8 to 10, the first reinforcement layer 24 is a separate member from the second reinforcement layer 26 with a portion of the base layer 22 separating the first reinforcement layer 24 from the second reinforcement layer 26. In particular, as seen in FIG. 8, the first reinforcement layer 24 and the second reinforcement layer 26 are separated at along the bottom of the toe portion 22*a*, the heel portion 22*b* and the middle portion 22*c*. As seen in FIG. 9, the first reinforcement layer 24 and the second reinforcement layer 26 are separated at the toe portion 22*a*. As seen in FIG. 10, the first reinforcement layer 24 and the second reinforcement layer 26 are separated at the heel portion 22*b*. Also, as seen in FIG. 10, a top edge 24*a* of the first reinforcement layer 24 is disposed above a most outwardly protruding point P1 of the heel portion 22*b* in the width direction D2 perpendicular to the toe-heel direction D1 and extending between the outer side and the inner side. Likewise, a top edge 26*a* of the second reinforcement layer 26 is disposed above a most outwardly protruding point P2 of the heel portion 22*b* in the width direction D2 perpendicular to the toe-heel direction D1 and extending between the outer side and the inner side.

Preferably, the base layer 22 is a fabric material. More preferably, the base layer 22 is preferably a knitted fabric material or a woven fabric material. The base layer 22 can be formed of an expandable or stretchable material or a non-expandable material. Preferably, the base layer 22 is formed of an expandable or stretchable material such that the base layer 22 follows the wearer's foot.

On the other hand, the first reinforcement layer 24 includes at least one of a rubber material, a resin material and a leather material. Likewise, the second reinforcement layer 26 includes at least one of a rubber material, a resin material and a leather material. The leather material for the first reinforcement layer 24 and/or the second reinforcement layer 26 can be either a natural leather or a synthetic leather. The first reinforcement layer 24 can be the same material as the material of the second reinforcement layer 26. Alternatively, the first reinforcement layer 24 can be a different material from the material of the second reinforcement layer 26. Preferably, the first reinforcement layer 24 and the second reinforcement layer 26 are the same material. The first reinforcement layer 24 and the second reinforcement layer 26 are attached to an exterior surface of the base layer 22. For example, the first reinforcement layer 24 and the second reinforcement layer 26 are attached to the base layer 22 by stitching and/or an adhesive. In any case, the first reinforcement layer 24 and the second reinforcement layer 26 provide lateral support to the base layer 22.

In the first embodiment, as seen in FIGS. 6 to 10, the upper 12 further comprises an instep portion 28 integrated with the base layer 22. As seen in FIGS. 6 and 7, the first reinforcement layer 24 and the second reinforcement layer 26 are separated at the instep portion 28. In other words, the first reinforcement layer 24 and the second reinforcement layer 26 do not overlap with the instep portion 28. The instep portion 28 can be the same material as the base layer 22, or can be a different material from the base layer 22. The instep portion 28 is preferably a fabric material. More preferably, the instep portion 28 is a knitted fabric material that is resiliently stretchable or expandible. The instep portion 28 is attached to a top edge of the base layer 22. For example, the instep portion 28 is attached to the base layer 22 by stitching or bonding. Alternatively, the base layer 22 and the instep portion 28 can be a one-piece member that is knitted together.

The instep portion 28 is integrally formed with an ankle portion 29. The ankle portion 29 defines an opening 29*a* for entry and removal of the foot of the wearer. The ankle portion 29 is preferably made of a fabric material that can be the same material as the instep portion 28 or can be a different material from the instep portion 28. For example, the instep portion 28 and the ankle portion 29 can be a one-piece member that is knitted together. Alternatively, the ankle portion 29 can be a separate piece that is attached to the instep portion 28 by stitching or bonding. Preferably, the ankle portion 29 is a knitted fabric material that is resiliently stretchable or expandable. In this way, the ankle portion 29 is configured to grip the foot of the wearer.

Referring back to FIGS. 1 to 5, the upper 12 further comprises a closing arrangement 30 provided to the base layer 22. The closing arrangement 30 is a closure or a fastening structure for securing the shoe 10 to a wearer's foot. Preferably, the closing arrangement 30 includes a shoelace 32. The shoelace 32 is provided in the midfoot portion 18 of the shoe 10 in the area of the instep portion 28. In the first embodiment, the closing arrangement 30 includes a tightener 34 coupled to the shoelace 32. The tightener 34 is configured to pull the shoelace 32 to tighten the shoe 10 on a wearer's foot, and to loosen the shoelace 32 to loosen the shoe 10 on a wearer's foot.

Here, the closing arrangement 30 includes a first strap 36, and a second strap 38. The first strap 36 includes a first eyelet 36*a*, and the second strap 38 includes a plurality of second eyelets 38*a*. The shoelace 32 is threaded through the first eyelet 36*a* and the second eyelets 38*a*. The first strap 36 is provided to the outer side of the centerline CL. The first strap 36 is attached to the bottom of the upper 12. The second strap 38 is provided to the inner side of the centerline CL. The first strap 36 and the second strap 38 are disposed between the upper 12 and the sole 14. Here, the first strap 36 and the second strap 38 are separate pieces. Alternatively, the first strap 36 and the second strap 38 can be a single piece of material. The tightener 34 is provided to one of the first strap 36 and the second strap 38. Here, the tightener 34 is provided to the first strap 36. In the first embodiment, the tightener 34 includes a reel based tightener 34.

Still referring back to FIGS. 1 to 5, the upper 12 further comprises a third reinforcement layer 40 overlying the base layer 22 and at least one of the first reinforcement layer 24 and the second reinforcement layer 26. In the first embodiment, the third reinforcement layer 40 includes the first strap 36 and the second strap 38. Thus, the third reinforcement layer 40 overlies the base layer 22, the first reinforcement layer 24 and the second reinforcement layer 26. The third reinforcement layer 40 (the first strap 36 and the second strap 38) includes at least one of a rubber material, a resin material and a leather material. The leather material for the first strap 36 and the second strap 38 can be either a natural leather or a synthetic leather. The first strap 36 and the second strap 38 can be the same material as the material of the first reinforcement layer 24 and/or the second reinforcement layer 26. Alternatively, first strap 36 and the second strap 38 can be a different material from the materials of the first reinforcement layer 24 and the second reinforcement layer 26. Here, the first reinforcement layer 24, the second reinforcement layer 26, the first strap 36 and the second strap 38 are the same material such as a leather material.

Referring now to FIGS. 15 to 18, a shoe 110 is illustrated in accordance with a second embodiment. The shoe 110 basically comprises an upper 112 and a sole 114. The sole 114 is identical to the sole 14, which is discussed above. The upper 112 basically comprises a base layer 122, a first reinforcement layer 124, a second reinforcement layer 126, an instep portion 128 with an ankle portion 129, and a closing arrangement 130. The base layer 122 is identical to the base layer 22, except that the base layer 122 has been modified to accommodate the closing arrangement 130, as explained below. The first reinforcement layer 124, the second reinforcement layer 126 and the instep portion 128 are identical to the first reinforcement layer 24, the second reinforcement layer 26 and the instep portion 28, which is discussed above. In view of the similarity between the first embodiment and the second embodiment, the descriptions of the second embodiment will focus only on the differences between the first embodiment and the second embodiment for the sake of brevity.

In the second embodiment, the closing arrangement 130 includes a shoelace 132. Here, the closing arrangement 130 further includes a lace guide 135 provided to the base layer 122. The shoelace 32 is laced through the lace guide 135. In particularly, in the second embodiment, the lace guide 135 includes a plurality of first eyelets 136*a* and a plurality of second eyelets 138*a*. The first eyelets 136*a* are provided to the base layer 122 on the outer side of the centerline CL. The second eyelets 138*a* are provided to the base layer 122 on the inner side of the centerline CL. The shoelace 32 is laced through the first eyelets 136*a* and the second eyelets 138*a* in a conventional manner.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

The phrase "at least one of" as used in this disclosure means "one or more" of a desired choice. For one example, the phrase "at least one of" as used in this disclosure means "only one single choice" or "both of two choices" if the number of its choices is two. For another example, the phrase "at least one of" as used in this disclosure means "only one single choice" or "any combination of equal to or more than two choices" if the number of its choices is equal to or more than three. Also, the term "and/or" as used in this disclosure means "either one or both of".

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention.

The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An upper for of a shoe, the upper comprising:

a base layer including a toe portion and a heel portion, the base layer having a joint free three-dimensional shape at least partly defining an interior foot receiving space;

a first reinforcement layer disposed on an outer side of a centerline of a toe-heel direction of the upper, and overlying a first heel area of the heel portion;

a second reinforcement layer disposed on an inner side of the centerline, and overlying a second heel area of the heel portion;

a third reinforcement layer overlying the base layer and at least one of the first reinforcement layer and the second reinforcement layer, an entirety of the third reinforcement layer being disposed forward of the heel portion, the third reinforcement layer including a first strap provided to the outer side of the centerline and a second strap provided to the inner side of the centerline; and a closing arrangement including a tightener provided to one of the first strap and the second strap of the third reinforcement layer, the tightener including a reel based tightener, the first reinforcement layer and the second reinforcement layer being separated at the heel portion.

2. The upper according to claim 1, wherein the first reinforcement layer overlies a first toe area of the toe portion, the second reinforcement layer overlies a second toe area of the toe portion, and the first reinforcement layer and the second reinforcement layer are separated at the toe portion.

3. The upper according to claim 1, wherein the first reinforcement layer extends continuously from the heel portion to the toe portion as a single strip.

4. The upper according to claim 1, wherein the second reinforcement layer extends continuously from the heel portion to the toe portion as a single strip.

5. The upper according to claim 1, further comprising an instep portion integrated with the base layer, and the first reinforcement layer and the second reinforcement layer are separated at the instep portion.

6. The upper according to claim 1, wherein the first reinforcement layer includes at least one of a rubber material, a resin material and a leather material, and the second reinforcement layer includes at least one of a rubber material, a resin material and a leather material.

7. The upper according to claim 1, wherein the base layer is a fabric material.

8. The upper according to claim 1, wherein the closing arrangement includes a shoelace.

9. The upper according to claim 8, wherein the closing arrangement includes a lace guide provided to the base layer, and the shoelace is laced through the lace guide.

10. The upper according to claim 8, wherein the tightener is coupled to the shoelace.

11. The upper according to claim 1, wherein the base layer further includes a middle portion, and the toe portion, the heel portion and the middle portion define a sock shape.

12. The upper according to claim 1, wherein a top edge of the first reinforcement layer is disposed above a most outwardly protruding point of the heel portion in a width direction perpendicular to the toe-heel direction and extending between the outer side and the inner side.

13. The upper according to claim 1, wherein a top edge of the second reinforcement layer is disposed above a most outwardly protruding point of the heel portion in a width direction perpendicular to the toe-heel direction and extending between the outer side and the inner side.

14. A shoe comprising the upper according to claim 1, and further comprising a sole attached to the upper.

15. The upper according to claim 1, wherein the third reinforcement layer overlies a portion of the base layer on which the first and second reinforcement layers are not disposed.

16. The upper according to claim 1, wherein a rearmost end of each of the first and second reinforcement layers approaches and is proximate to the centerline.

17. An upper for of a shoe, the upper comprising:

a base layer including a toe portion and a heel portion, the base layer having a joint free three-dimensional shape at least partly defining an interior foot receiving space;

a first reinforcement layer disposed on an outer side of a centerline of a toe-heel direction of the upper, and overlying a first heel area of the heel portion;

a second reinforcement layer disposed on an inner side of the centerline, and overlying a second heel area of the heel portion;

a third reinforcement layer overlying the base layer and at least one of the first reinforcement layer and the second reinforcement layer; and a closing arrangement provided to the third reinforcement layer, the closing arrangement including a shoelace and a tightener coupled to the shoelace, the tightener including a reel based tightener; and the first reinforcement layer and the second reinforcement layer being separated at the heel portion, the tightener being disposed on the third reinforcement layer.

* * * * *